US009181597B1

(12) United States Patent
Hawk et al.

(10) Patent No.: US 9,181,597 B1
(45) Date of Patent: Nov. 10, 2015

(54) CREEP RESISTANT HIGH TEMPERATURE MARTENSITIC STEEL

(71) Applicants: Jeffrey A. Hawk, Corvallis, OR (US); Paul D. Jablonski, Salem, OR (US); Christopher J. Cowen, Cornwall, NY (US)

(72) Inventors: Jeffrey A. Hawk, Corvallis, OR (US); Paul D. Jablonski, Salem, OR (US); Christopher J. Cowen, Cornwall, NY (US)

(73) Assignee: U.S. Department of Energy, Washington, DC (US)

( * ) Notice: Subject to any disclaimer, the term of this patent is extended or adjusted under 35 U.S.C. 154(b) by 153 days.

(21) Appl. No.: 13/868,139

(22) Filed: Apr. 23, 2013

(51) Int. Cl.

| | |
|---|---|
| ***C22C 38/44*** | (2006.01) |
| ***C21D 8/00*** | (2006.01) |
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/46*** | (2006.01) |
| ***C22C 38/48*** | (2006.01) |
| ***C22C 38/52*** | (2006.01) |
| ***C22C 38/54*** | (2006.01) |
| ***C22C 38/40*** | (2006.01) |

(52) U.S. Cl.

CPC ..... *C21D 8/005* (2013.01); *C21D 6/004* (2013.01); *C21D 6/005* (2013.01); *C21D 6/008* (2013.01); *C22C 38/001* (2013.01); *C22C 38/02* (2013.01); *C22C 38/04* (2013.01); *C22C 38/40* (2013.01); *C22C 38/44* (2013.01); *C22C 38/46* (2013.01); *C22C 38/48* (2013.01); *C22C 38/52* (2013.01); *C22C 38/54* (2013.01)

(58) Field of Classification Search

CPC ..... C22C 38/40–38/54
USPC ..... 148/325; 420/36–39
See application file for complete search history.

(56) References Cited

U.S. PATENT DOCUMENTS

| | | | | |
|---|---|---|---|---|
| 5,427,635 | A | 6/1995 | Bletton et al. | |
| 5,779,821 | A * | 7/1998 | Ishii et al. | 148/326 |
| 5,911,842 | A * | 6/1999 | Shiga et al. | 148/325 |
| 6,723,182 | B1 | 4/2004 | Bahmiller | |
| 6,890,393 | B2 | 5/2005 | Buck | |
| 7,186,304 | B2 | 3/2007 | Chin et al. | |
| 8,017,071 | B2 | 9/2011 | Magee | |
| 2006/0060270 | A1 * | 3/2006 | Klueh et al. | 148/609 |
| 2007/0023108 | A1 | 2/2007 | Blanke et al. | |
| 2011/0030851 | A1 | 2/2011 | Yamauchi et al. | |

* cited by examiner

*Primary Examiner* — Brian Walck
(74) *Attorney, Agent, or Firm* — James B. Potts; Brian J. Lally; John T. Lucas

(57) ABSTRACT

The disclosure provides a creep resistant alloy having an overall composition comprised of iron, chromium, molybdenum, carbon, manganese, silicon, nickel, vanadium, niobium, nitrogen, tungsten, cobalt, tantalum, boron, and potentially additional elements. In an embodiment, the creep resistant alloy has a molybdenum equivalent Mo(eq) from 1.475 to 1.700 wt. % and a quantity (C+N) from 0.145 to 0.205. The overall composition ameliorates sources of microstructural instability such as coarsening of $M_{23}C_6$ carbides and MX precipitates, and mitigates or eliminates Laves and Z-phase formation. A creep resistant martensitic steel may be fabricated by preparing a melt comprised of the overall composition followed by at least austenizing and tempering. The creep resistant alloy exhibits improved high-temperature creep strength in the temperature environment of around 650° C.

17 Claims, 2 Drawing Sheets

CREEP RESISTANT HIGH TEMPERATURE MARTENSITIC STEEL

GOVERNMENT INTERESTS

The United States Government has rights in this invention pursuant to the employer-employee relationship of the Government to the inventors as U.S. Department of Energy employees and site-support contractors at the National Energy Technology Laboratory.

FIELD OF THE INVENTION

One or more embodiments relates to a creep resistant alloy comprised of iron, 9.75 to 10.25 wt. % chromium, 1.0 to 1.5 wt. % molybdenum, and other elements. A creep resistant martensitic steel is fabricated from a melt comprised of the overall composition generally followed by at least ingot homogenization, austenizing and tempering. The creep resistant alloy exhibits improved high-temperature creep strength in the temperature environment of around 650° C.

BACKGROUND

Creep behavior and degradation of creep properties of high-temperature materials are phenomena of major practical relevance, often limiting the lives of components and structures designed to operate for long periods under stress at elevated temperatures. In ultra supercritical steam turbines operating at temperatures up to 600° C., the rotors, airfoils, rotor casing, valve chest and other ancillary components are generally composed of high Cr (9-12%) martensitic steel. High Cr (9-12%) martensitic steel are generally comprised of iron with between 9-12 weight % (wt. %) chromium, relatively low carbon contents, and additions of alloying elements such as molybdenum, tungsten, cobalt, vanadium, niobium, nitrogen, and others.

Creep is a time-dependent deformation of a material under an applied load which most often occurs at elevated temperature. Physical models of creep behavior in creep-resistant steels such as high Cr (9-12%) martensitic steel rely on a stable microstructure built from martensitic laths and organized into blocks, packets and prior austentite grains and stabilized by $M_{23}C_6$ carbides, which assume resistance to increments in creep strain depending on barriers to dislocation movement through climb and glide, where a dense dislocation network, fine particle dispersions, and elastic strain fields in the matrix are generally considered to present effective barriers to dislocation movement. Changes in the effectiveness of these barriers lead to changes in creep behavior of materials. Structural changes in the material usually accelerate the creep, which in turn accelerates the rate of appearance of intergranular creep damage. Creep terminates in rupture when unabated and has a significant impact on component lifetime.

In high Cr (9-12%) martensitic steels, structural changes usually accelerate the creep, which in turn accelerates the rate of appearance of intergranular creep damage. Correspondingly, microstructural stability during service is of great importance. The structural features generally expected to exert an influence on the creep rupture properties in high Cr (9-12%) martensitic steels include the martensitic lath and associated hierarchical structure (blocks and packets), the prior austenite grain structure, the formation of a three-dimensional network of $M_{23}C_6$ carbides associated with such structures, the dislocation density within the martensite laths, the polygonization conditions of the subgrains, the presence of fine, uniformly dispersed MX, nitrides, and carbonitrides within the martensitic lath structure, and the solid solution strengthening of the martensitic lath matrix by elements such as molybdenum, tungsten and cobalt. The high Cr (9-12%) martensitic steels are typically strengthened by a combination of matrix solute strengthening agents such as cobalt, molybdenum, and tungsten, matrix transformation to martensite with heat treatments, and MX matrix precipitate and $M_{23}C_6$ particle formation on prior austenite/packet/block/lath/subgrain boundaries. Creep strength is generally achieved by a high dislocation density and the combination of frictional drag on dislocations from solute in the matrix and also MX precipitate formation impeding dislocation movement as discrete obstacles during creep. As is understood, the term MX particle denotes a nitride or carbonitride particle such as (Nb, V)(N, C), where M represents metal atoms such as titanium, niobium, tantalum, zirconium, hafnium, and others, and X represents interstitial atoms. The conditions under which different metal atoms form MX particles vary with the compositions of steel alloys. Similarly, as is understood, $M_{23}C_6$ indicates a carbide such as $(Cr, Fe, Mo, W)_{23}C_6$, where M is the carbide forming element such as chromium, iron, molybdenum, tungsten, and others. The $M_{23}C_6$ carbides primarily form at prior austenite boundaries, packet, block and lath boundaries while MX carbonitrides precipitate in the ferrite matrix, typically during the tempering process.

The standard heat treatments for high Cr (9-12%) martensitic steels generally involve austenization and/or normalizing and tempering. The austenization is usually carried out at high temperatures above the $A_{c1}$ temperature in order to dissolve most carbides and nitrides and obtain a fully austenitic microstructure. After cooling to room temperature, the microstructure generally becomes martensitic, with a relatively high dislocation density. The martensite is a distorted tetragonal form of the ferrite bcc crystal structure. Normally air cooling of 9-12% Cr steels is sufficient for martensitic transformation, because the high levels of chromium retard the diffusion of carbon and mitigates the formation of ferrite. This is typically followed by tempering in order to recover ductility.

With the necessary emphasis on creep behaviors at higher temperatures, heat resistant alloys providing improved creep performance provide obvious advantage.

Correspondingly, presented here is a creep resistant alloy comprised of at least iron (Fe), chromium (Cr), molybdenum (Mo), carbon (C), manganese (Mn), silicon (Si), nickel (Ni), vanadium (V), niobium (Nb), nitrogen (N), tungsten (W), cobalt (Co), tantalum (Ta), boron (B), and potentially additional elements. The overall composition strengthens the matrix with solute additions and precipitates, stabilizes the various grain and sub-grain structures using carbides, and engenders a high density of dislocations with thermo-mechanical processing (TMP) and heat treatment. The overall composition ameliorates sources of microstructural instability such as coarsening of $M_{23}C_6$ carbides and MX precipitates, and mitigates or eliminates Laves and Z-phase formation by positional control of composition. In an embodiment, the creep resistant alloy exhibits significantly improved high-temperature creep strength in the temperature environment of around 650° C. as compared to other creep resistant martensitic steels, such as COST FB2, COST E, and COST B2 steels.

Additional objects, aspects, and advantages of the present disclosure will become better understood with reference to the accompanying description and claims.

SUMMARY

The disclosure provides a creep resistant alloy having an overall composition comprised of iron and further comprised of from 9.75 to 10.25 wt. % Cr, from 1.0 to 1.5 wt. % Mo, from 0.13 to 0.17 wt. % C, from 0.25 to 0.50 wt. % Mn, from 0.08 to 0.15 wt. % Si, from 0.15 to 0.30 wt. % Ni, from 0.15 to 0.25 wt. % V, from 0.05 to 0.08 wt. % Nb, from 0.015 to 0.035 wt. % N, from 0.25 to 0.75 wt. % W, from 1.35 to 1.65 wt. % Co, from 0.20 to 0.30 wt. % Ta, and from 70 ppm to 110 ppm B. In an embodiment, the creep resistant alloy has a molybdenum equivalent Mo(eq) from 1.475 to 1.700 wt. % and a quantity (C+N) is 0.145 to 0.205. In additional embodiments, the creep resistant alloy is comprised of less than 0.004 wt. % Ti, less than 0.003 wt. % Cu, less than 10 ppm O, and less than 100 ppm S.

The creep resistant alloy may be formed into a cast ingot by generating a melt having the disclosed overall composition and allowing the cast ingot to solidify. The cast ingot may be homogenized at a temperature between 1100° C.-1150° C. for at least one hour, followed by a temperature greater than 1250° C. but less than 1325° C. for at least 4 hours. In an embodiment, the homogenized ingot has a residual inhomogeneity less than 10%, and preferably less than 1%. Following homogenization, the homogenized ingot may be hot worked in the austenite phase field at a temperature generally between 850° C. and 1100° C. and preferably between 900° C. and 1000° C. In an embodiment, the homogenized ingot is hot worked to produce an ASTM grain size greater than or equal to 2.5.

The heat resistant steel may be fabricated into a creep resistant martensitic steel by generating the cast ingot and austenizing at a temperature from about 1100° C. to about 1200° C. for a period of from about 30 minutes to about 2 hours, air cooling to generate martensite, then tempering at a temperature from about 650° C. to about 750° C. for a period of from about 1 hour to about 4 hours followed by air cooling. The heat resistant martensitic steel possesses significantly improved creep properties over commercially available steels, such as COST CB2.

The novel process and principles of operation are further discussed in the following description.

DETAILED DESCRIPTION

Figure 1:
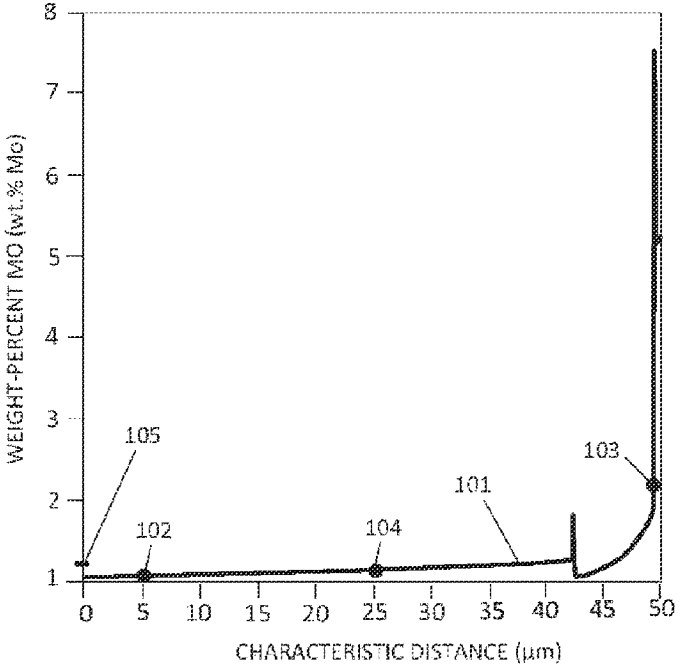
FIG. 1 illustrates the concentration profile of an alloying element prior to a homogenization.

The following description is provided to enable any person skilled in the art to use the invention and sets forth the best mode contemplated by the inventor for carrying out the invention. Various modifications, however, will remain readily apparent to those skilled in the art, since the principles of the present invention are defined herein specifically to provide a creep resistant alloy having a specified overall composition.

The creep resistant alloy disclosed is comprised of at least iron, chromium, molybdenum, carbon, manganese, silicon, nickel, vanadium, niobium, nitrogen, tungsten, cobalt, tantalum, boron, and potentially additional elements in an overall composition. The overall composition strengthens the matrix with solute additions and precipitates, stabilizes the various grain and sub-grain structures using carbides, and engenders a high density of dislocations with thermo-mechanical processing (TMP) and heat treatment. The overall composition ameliorates sources of microstructural instability such as coarsening of $M_{23}C_6$ carbides and MX precipitates, and mitigates or eliminates Laves and Z-phase formation by positional control of composition. A creep resistant martensitic steel may be fabricated by preparing a melt comprised of the overall composition followed by at least austenizing and tempering. The creep resistant steel exhibits improved high-temperature creep strength in the temperature environment of around 650° C.

Creep Resistant Alloy Overall Composition

The overall composition of the creep resistant alloy is comprised of at least iron (Fe), Chromium (Cr), molybdenum (Mo), carbon (C), manganese (Mn), silicon (Si), nickel (Ni), vanadium (V), niobium (Nb), nitrogen (N), tungsten (W), cobalt (Co), tantalum (Ta), boron (B), and potentially additional elements. The overall composition is preferably restricted to a particular one for the following reasons.

Chromium:

Chromium is an essential element for improving the creep rupture strength of steel and is also added to give the steel a satisfactory level of hot corrosion (oxidation) resistance. Chromium is also a major constituent in the formation of carbides as well as dissolving in the matrix as it is an essential element in the formation of a stable oxide scale for sustained high-temperature oxidation resistance. Creep rupture strength increases with Cr content from 8.5 wt. % up to about 9.75 wt. % to 10.0 wt. % after which the creep rupture strength decreases. With a chromium content under 9.75 wt. %, these desired combined effects of creep rupture strength and oxidation resistance cannot be obtained since only a discontinuous layer of Cr-oxide is formed. However, with a chromium content over 10.25 wt. %, and especially over 11.0 wt. %, the amount of delta-ferrite increases to impair creep rupture strength and toughness. Therefore, the chromium content should be limited within the range 9.75-10.25 wt. %.

Molybdenum:

Molybdenum is added to achieve solid solution strengthening and improve creep rupture strength. Molybdenum is also a ferrite stabilizing element. Addition of molybdenum must be carefully controlled. Molybdenum additions up to about 1.5 wt. % have been shown to improve creep rupture strength. With a molybdenum content under 1.0 wt. %, the desired improvement in creep rupture strength is minimal. However, with a molybdenum content over 1.5 wt. %, and especially over 1.75 wt. %, during service lifetimes in high temperature environments, the formation of 5-ferrite and the precipitation of Laves phase ($Fe_2Mo$) reduces the solid solution strengthening effect, leading eventually to embrittlement which significantly impacts toughness. Furthermore, concentrations of Mo>1.75 wt. % can be difficult to homogenize effectively, which further inhibits the ability to obtain positional control of chemistry. Therefore, the molybdenum content should be limited within the range 1.0-1.5 wt. %.

Carbon:

Carbon combines with Cr, Mo, V, Ta and Nb to form carbide phases, which result in improved high-temperature creep strength through increased microstructural stability under prolonged exposures at elevated temperature. Carbon also serves to stabilize the austenite in the steel. Typically, carbon levels above 0.05 wt. % are needed. With reduced carbon content, the ferritic structure is preferred, degrading the strength due to the decreased amount of austenite available to transform to martensite upon quenching. With ferrite stabilizing elements provided for solid solution strengthening (Mo and W), a carbon level greater than 0.12 wt. % is needed for austenite stabilization, and in order to achieve the necessary volume fraction of carbide ($M_{23}C_6$) for improve creep rupture strength, a carbon level of 0.15 wt. % is desired. With increased carbon content, the $Ac_1$ point may decrease markedly, reducing applicability for high temperature service. Additionally, an increase in the amount of carbon greater than 0.20 wt. % increases the volume fraction of carbide, decreasing the ductility of the steel and increasing the hardness to an undesirable level, thereby degrading formability and weldability. Therefore, carbon at too low a level leaves the matrix depleted of carbide phases and with an excess of carbide forming elements this can lead to the formation of undesired phases such as Laves and Z-phase. The carbon content should, therefore, have an upper limit of 0.17% by weight. The carbon content should be limited within the range 0.13-0.17 wt. %.

Manganese (Mn):

Manganese is added to deoxidize the steel, to improve hot formability and to facilitate the removal of impurities such as phosphorus and sulfur during melting. Manganese also serves to stabilize austenite while suppressing the formation of δ-ferrite. However, manganese at elevated levels reduces creep rupture strength. The addition of more than 1 wt. % manganese to the steel is undesirable. Therefore, in order to facilitate hot formability while not adversely affecting creep rupture strength, the manganese content should be limited within the range 0.25-0.50 wt. %.

Silicon (Si):

Silicon is added to the steel as a deoxidizing agent, to improve the castability, and to increase resistance to steam oxidation, but increased amounts may also promote the formation of δ-ferrite and Laves phase, impairing creep rupture strength. Moreover, silicon at elevated levels reduces high temperature strength, and in particular, creep rupture strength. Silicon also preferentially segregates at grain boundaries, reducing the toughness. Therefore, the silicon content should be limited within the range 0.08-0.15 wt. %.

Nickel (Ni):

Nickel, when present, is an austenite stabilizer, and may be added to effectively stabilize a martensitic structure after quenching. Nickel suppresses the formation of δ-ferrite by decreasing the chromium (Cr) equivalent, however, higher nickel contents may lead to an inadmissible lowering of the $A_{c1}$ temperature, so that an annealing treatment at high temperatures is difficult and creep resistance degrades. Additionally, increases in nickel content have a significant impact on cost. Therefore, the nickel content should be limited within the range 0.15-0.30 wt. %.

Vanadium (V):

Vanadium combines with carbon and nitrogen to form finely dispersed precipitates such as V(C,N), which are stable at high temperature for an extended period of time and effective for improving long-term creep rupture strength. If the content is less than 0.10 wt. %, the effect is minimal. However, in increased amounts, the tendency to form δ-ferrite increases and the tendency to generate other forms of carbides decreases, especially if the content is 0.30% by weight, or greater, due to the consumption of carbon and nitrogen. Therefore, vanadium content should be limited within the range 0.15-0.25 wt. %.

Niobium (Nb):

Niobium, like vanadium, combines with carbon and nitrogen to form fine precipitates such as Nb (C, N) which are effective to improve creep rupture strength. Additionally, niobium-rich precipitates refine the steel grain structure and aid to prevent grains of austenite from coarsening excessively during the austenizing heat treatment. If the amount of niobium added is less than 0.01% by weight the volume fraction of precipitates is low and the effect as noted is minimal. However, increasing niobium content may suppress the precipitation of other nitrides, decreasing the vanadium precipitates which are effective for creep rupture resistance and consuming carbon in the matrix, thereby reducing the martensitic lath number density as well as the number density of other carbide precipitates such as $M_{23}C_6$ and decreasing the long-term creep rupture resistance. Furthermore, high Nb content can promote primary carbide formation, the size of which can be excessively large, thereby promoting microstructural damage in service. High concentrations of Nb can also be hard to homogenize which inhibits the ability to obtain positional control of chemistry. Niobium added in small quantity can dissolve in vanadium nitride, consequently improving the stability of the vanadium nitride. Therefore, niobium content should be limited within the range 0.05-0.08 wt. %.

Nitrogen (N):

Nitrogen in the presence of carbon combines with vanadium and niobium to form carbonitrides, which are effective to improve creep rupture strength and are extremely stable thermally. Nitrogen added to steel increases creep rupture strength up to 0.07% by weight after which the effect diminishes. Furthermore, nitrogen stabilizes austenite and greatly mitigates the formation of δ-ferrite. Nitrogen at a level greater than 0.01% by weight facilitates these effects. However, increasing nitrogen content to a level greater than 0.08% by weight may degrade formability and weldability through the formation of coarse nitrides particles, and from gas pockets and voids during solidification of the ingot, which subsequently open during hot working leading to additional defects. Creep rupture strength is correspondingly lowered as is ductility and toughness. Nitrogen in the presence of boron can form boron nitride (BN), so control of both elements is important. Therefore, nitrogen content should be limited to within the range 0.015-0.035 wt. %.

Tungsten (W)

Tungsten substantially contributes to solid solution strengthening of the steel and contributes to the formation of stable nitrides, thereby improving creep resistance and long-term stability of the steels. If the weight fraction of tungsten alone added is less than 0.30% the effect is minimal. Tungsten is a ferrite stabilizing element. When tungsten is added at levels approaching 5.0 wt. %, or greater, the formation of δ-ferrite and the Laves phase is enhanced with corresponding detrimental effects on creep rupture strength. In the presence of molybdenum, the fraction of tungsten added to the steel should be determined as the molybdenum equivalent, or Mo(eq). The Mo(eq) is equal to ½ the weight fraction of tungsten. As mentioned in the discussion for molybdenum, creep rupture strength is enhanced with molybdenum additions in the range of 1.50 to 1.75 percent by weight. Correspondingly, the effect also applies to the Mo(eq). Therefore, the combined quantity by weight fraction of molybdenum and tungsten should be between 1.50 and 1.75. Furthermore, high concentrations of W can be hard to homogenize, which inhibits the ability to obtain positional control of chemistry. Therefore, tungsten content should be limited to within the range 0.25 to 0.75 wt. %, and will depend upon the level of molybdenum in the steel.

Cobalt (Co)

Cobalt is an austenite stabilizing element in the steel and increases the creep rupture strength through solid solution strengthening. In light of the additions of molybdenum and tungsten for solid solution strength, both of which are ferrite stabilizing elements affecting the Cr(eq), cobalt must also be added to the steel to offset this and stabilize the austenite through the Ni(eq). Cobalt unlike nickel does not reduce high temperature creep rupture strength. Also, cobalt added at a weight fraction less than 0.50% will have minimal effect. Cobalt at low levels (<0.10 wt. %) also has the effect of enhancing resistance to temper softening. Conversely, increasing the cobalt amounts may unduly lower the $A_{c1}$ temperature, and when cobalt additions are greater than 6.0 wt. % the ductility is decreased. Also, cobalt is expensive and its overall use should be controlled based on what is necessary to balance the effect of molybdenum and tungsten on the Cr(eq) in stabilizing the austenite structure in the steel through the Ni(eq). Furthermore, high concentrations of Co can be hard to homogenize, which inhibits the ability to obtain positional control of chemistry. Therefore, cobalt content should be limited to within the range 1.35 to 1.65 wt. % Co, and used to balance the effect of molybdenum and tungsten on the Cr(eq) through adjustment of the Ni(eq).

Tantalum (Ta)

Tantalum is utilized to form fine carbides and carbonitrides that serve to produce a fine grain structure in the steel, strengthen the material, suppresses the recovery of dislocations during creep and enhances the creep rupture strength. Within the overall composition, the Ta-based compounds formed are more stable than those formed with other elements such as Cr, V, W, and Nb. Tantalum also has precipitation hardening effects when contained in niobium precipitates. The effect is beneficial at a level of at least 0.01 wt. %, and certainly at 0.03 wt. %, but when the tantalum weight fraction is greater than about 0.30% delta-ferrite formation is possible, and at 0.5% the toughness is adversely affected as is the creep rupture strength through the formation of coarse tantalum nitrides and/or carbonitrides. Also, increased amounts of tantalum may suppress the precipitation of other nitrides and carbonitrides and consume solid solution carbon from the matrix, thereby reducing the carbide precipitates such as $M_{23}C_6$ and decreasing the long-term creep resistance while having a detrimental effect on the $A_{c1}$ temperature. High tantalum content can promote primary carbide formation which can be excessively large and can promote microstructural damage in service. Furthermore, high concentrations of tantalum can be hard to homogenize, which inhibits the ability to obtain positional control of chemistry. Therefore, tantalum content should be limited to within the range 0.20 to 0.30 wt. % Ta.

Boron (B)

Boron stabilizes the $M_{23}C_6$ precipitates by inhibiting coarsening of the $M_{23}C_6$ carbides. Boron also segregates at boundaries, reinforcing the boundaries and enhancing creep resistance at a high temperature. These effects cannot be obtained at a boron level less than 0.001 wt. % (10 ppm). However, the weight fraction of boron must be carefully controlled to prevent the formation of boron nitride (BN) when nitrogen is present in the steel, as in this example. Boron nitride formation is detrimental because nitrogen tied up in the boron nitride phase is subsequently unavailable to form matrix MX precipitates. Also, increasing amounts of boron to levels greater than 0.02 wt. % (200 ppm) require higher austenization temperatures be used to adequately disperse the boron within the steel, which in turn leads to an increase in the grain size, thereby degrading mechanical properties such as ductility and toughness through the formation of coarse boron nitride phase. Also, hot workability is adversely affected at these boron levels. Therefore, boron content should be limited to within the range from 0.007 wt. % (70 ppm) to 0.011 wt. % (110 ppm) B.

The overall composition of the creep resistant alloy strengthens the matrix with solute additions and precipitates, stabilizing the various grain and sub-grain structures using carbides, and creating a high density of dislocations through the martensitic phase transformation using thermo-mechanical processing (TMP) and heat treatment. The overall composition is intended to ameliorate sources of microstructural instability, such as coarsening of the $M_{23}C_6$ carbides and MX precipitates during prolonged exposure, and mitigate or eliminate Laves and Z-phase formation. The overall composition of the creep resistant alloy generally contains C, V, Nb, Ta, and N in the amounts specified to generate MX precipitates, slowing down dislocation movement within the martensitic laths. A balanced amount of Mo and W are specified for solution and precipitation hardening by $M_{23}C_6$. The additions of Co, Mn, Ni, and C suppress δ-ferrite and provide additional precipitate strengthening and oxidation resistance. The addition of B stabilizes $M_{23}C_6$ precipitates and the sub-grain structure and strengthens the grain boundaries. Cr generally provides for oxidation resistance.

In an embodiment, the creep resistant alloy has a molybdenum equivalent Mo(eq) from 1.475 to 1.700 wt. % and a quantity (C+N) from 0.145 to 0.205, where the Mo(eq) is equal to the wt. % Mo added to one-half the wt. % W, and the quantity (C+N) is equal to the wt. % C added to the wt. % N. In another embodiment, the creep resistant alloy is comprised of less than 0.004 wt. % Ti and less than 0.003 wt. % Cu. In a further embodiment, the creep resistant alloy is comprised of less than 10 ppm O and less than 100 ppm S. In an additional embodiment, the creep resistant alloy is a creep resistant martensitic steel comprised of alpha-iron having a body-centered tetragonal crystal structure.

DESCRIPTION OF AN EMBODIMENT

The creep resistant, high temperature martensitic steel and the overall composition disclosed is generally based on a combined strategy of strengthening the matrix with solute additions and precipitates and stabilizing the various grain and sub-grain structures using carbides. Furthermore, the steel is stabilized by the use of a homogenization treatment in order to obtain positional control of the composition, and thus, avoid localize microstructural instabilities. Additionally, a high density of dislocations through the martensitic phase transformation can be created using thermo-mechanical processing (TMP) and heat treatment.

The overall composition disclosed may be initially prepared by preparing a melt having a melt composition within the overall composition disclosed, and allowing the melt to solidify into a cast object by allowing the melt to cool to a temperature less than about 175° C. The melt may be prepared with precursor elemental charge materials, or alternatively with commercially available steel in combination with precursor elemental or master alloy charge materials, provided the elemental ranges as outlined are satisfied. The melt having the melt composition may be initially produced in any ordinary equipment and process generally employed in the prior art. For example, the melt may be generated in a furnace such as an electric furnace, a converter, a vacuum induction melt furnace, and the like. The melt may then be cast into slabs, billets, or ingots in a continuous casting method or a slab-making method, and thereafter shaped into pipe, sheet, bar, rod, or other applicable product forms, generating the creep resistant alloy in the form of a cast object.

Homogenization:

The cast object may be homogenized to generate a homogenized casting.

Homogenization mitigates the effects of dendritic segregation during solidification and generates a more uniform chemical composition within the solid. In an embodiment, the cast object is homogenized at a temperature between 1100° C.-1150° C. for at least one hour, followed by a temperature greater than 1250° C. but less than 1325° C. for at least 4 hours thus providing positional control of the composition. As is understood, larger cast objects may have a coarser structure and require longer times at temperature, depending on the extent of homogenization desired.

Figure 2:
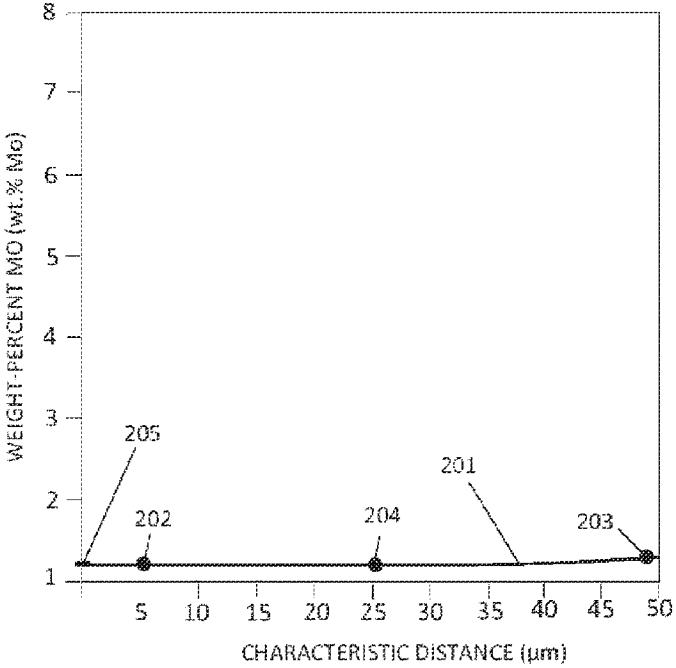
FIG. 2 illustrates the concentration profile of an alloying element subsequent to a homogenization.

In an embodiment, the creep resistant alloy is a martensitic steel having a residual inhomogeneity less than 10%, preferably less than 5%, and more preferably less than 1%. Here "residual inhomogeneity" means that a concentration profile of each element within a characteristic distance is within 10% of the weight percent of that element in the overall composition. Additionally, a "concentration profile" means a quantified weight percent of a given alloy element located at least a first point, a second point, and a third point distributed over the characteristic distance, where the characteristic distance is equal to from about 40% to about 60% of the secondary dendrite arm spacing (SDAS). Within the concentration profile, the first point is within the initial 20% of the characteristic distance, the second point is between the initial 20% and the initial 50% of the characteristic distance, and the third point is between the initial 80% and 100% of the characteristic distance. Preferably, the third point is between the initial 90% and 100% of the characteristic distance. As an example, FIG. 1 illustrates a concentration profile of a cast object prior to homogenization for the alloying element Mo, where the cast object is comprised of 1.25 wt. % Mo in the overall composition. The cast object has a SDAS of about 100 microns (μm), and a characteristic distance of 50 microns is indicated. At FIG. 1, Mo concentration profile 101 is comprised of at least a first point 102 is within the first 20% of the characteristic distance from 0-10 μm, a second point 104 is between the initial 20% and the initial 50% of the characteristic distance from 10-25 μm, and a third point 103 is between the initial 80% and 100% of the characteristic distance from 40-50 μm. Note that third point 103 is also between the initial 90% and 100% of the characteristic distance from 45-50 μm, although this is not strictly required. The 1.25 wt. % Mo of the overall composition is indicated on the wt. % Mo axis at 105, such that the range where Mo is within 10% of the weight percent of Mo in the overall composition extends from 1.125 wt. % Mo to 1.375 wt. % Mo. As illustrated, Mo concentration profile 101 extends outside the 1.125-1.375 wt. % Mo range at, for example, third point 103. Correspondingly, at FIG. 1, the residual inhomogeneity is greater than 10%. In contrast, FIG. 2 illustrates Mo concentration profile 201 comprised of first point 202 within the first 20% of the characteristic distance from 0-10 μm, second point 204 between the initial 20% and the initial 50% of the characteristic distance from 10-25 μm, and third point 203 between the initial 80% and 100% of the characteristic distance from 40-50 μm. At FIG. 2, the quantified weight percents comprising Mo concentration profile 201 and comprised of at least first point 202, second point 204, and third point 203 distributed over the 50 μm characteristic distance, all fall within the 10% range extending from 1.125 wt. % Mo to 1.375 wt. % Mo. Correspondingly, at FIG. 2, the residual inhomogeneity is less than 10%.

Concentration profiles such as Mo concentration profile 101 and Mo concentration profile 201 may be generated using any means known in the art, such as scanning electron microscopy. See e.g., Yan et al., "Microsegregation in Al-4.5Cu wt. % alloy: experimental investigation and numerical modeling," *Materials Science and Engineering A*302 (2001), and see Gungor, "A Statistically Significant Experimental Technique for Investigating Microsegregation in Cast Alloys," *Metallurgical Transactions A* 20A (1989), among others. The concentration profiles may also be generated using predictive computational methods based on predicted microsegregation profiles present following solidification and subsequent elemental diffusion during a prospective homogenization schedule. See e.g. Lippard et al., "Microsegregation Behavior during Solidification and Homogenization of AerMet100 Steel," *Metallurgical and Materials Transactions B* 29B (1998); see also Jablonski et al., "Homogenizing a Nickel-Based Superalloy: Thermodynamic and Kinetic Simulation and Experimental Results," *Metallurgical and Materials Transactions B* 40 (2009); see also Liu, "A Materials Research Paradigm Driven by Computation," *JOM* 61 (2009); see also U.S. patent application Ser. No. 13/528,958, Unpublished, (filing date Jun. 21, 2012) (Jablonski et al., applicants); and see also U.S. patent application Ser. No. 13/363,724, Unpublished, (filing date Feb. 1, 2012) (Jablonski et al., applicants), among others.

The characteristic distance over which the concentration profile is present is typically based on a secondary dendrite arm spacing (SDAS) and 40-60% of this value, as indicated. The SDAS is typically on the order of tens to a few hundred of microns scale. See e.g., D. R. Askelund and P. P. Phule, *The Science and Engineering of Materials* ($5^{th}$ Ed.), 2006, Nelson: Toronto, Ontario, among others. Additionally, in a dendritic solidification, a secondary dendrite is a dendrite directly branching from a primary or equiaxed dendrite. See e.g. Kotler et al., "Experimental Observations of Dendritic Growth," *Metallurgical Transactions* Vol. 3 (1972), among others. The SDAS may be determined directly by standard metallographic measurements or any method known in the art, such as the line-intercept method conducted over a statistically significant population of secondary dendrites, for example, at least 30 secondary dendrites. The SDAS may also be based on the metallurgist's experience from similar cast ingots produced under similar circumstances since it is well known to be dependent mainly on the solidification conditions.

Hot Working:

In an embodiment, following homogenization, the homogenized casting is hot worked in the austenite phase field at a temperature generally between 850° C. and 1100° C. and preferably between 900° C. and 1000° C. Here, "hot working" means the conduct of hot working operations such as forging, rolling, extrusion, and others. See e.g., Campbell, *Elements of Metallurgy and Engineering Alloys*, 2008, ASM International, Materials Park, Ohio, among others. Here, the "austenite phase field" refers to the equilibrium phase of a material above the $Ac_1$ temperature on heating or the $Ar_1$ temperature on cooling. As is understood, the austenite phase field may be determined for a given composition using various means known in the art, such as thermodynamic simulation software such as THERMO-CALC and JMAT-PRO, various formulae based on compositional make-up for a material, or evaluation utilizing, for example, single sensor differential thermal analysis (SS-DTA), or high temperature x-ray diffraction among other methods. See e.g., Andrew, "Empirical Formulae for the Calculation of Some Transformation Temperatures", *Journal of The Iron and Steel Institute*, Vol. 203, July, 1965, and see Pawlowski, "Critical points of hypoeutectoid steel—prediction of the pearlite dissolution finish temperature $Ac_{1f}$," *Journal of Achievements in Materials and Manufacturing Engineering* 49(2) (2011), among many others.

Austenizing and Tempering:

In a further embodiment, following homogenization, the homogenized casting may be austenized at a temperature from about 1100° C. to about 1200° C. for a period of from about 30 minutes to about 2 hours, then allowed to air cool to a room temperature below about 38° C., generating martensite. Following this austenization and first cooling, the creep resistant alloy may be tempered at a temperature from about 650° C. to about 750° C. for a period of from about 1 hour to about 4 hours, and allowed to air cool to a room temperature below about 38° C.

In some embodiments, the creep resistant alloy has an ASTM grain number of greater than or equal to 2.5. ASTM grain number may be determined through methods known in the art, such as lineal intercept and imaging methods. See e.g., ASTM E112-12, "Standard Test Methods for Determining Average Grain Size," and see ASTM E1382-97(2010), "Standard Test Methods for Determining Average Grain Size Using Semiautomatic and Automatic Image Analysis," and see ASTM E 1181-02(2008), "Standard Test Methods for Characterizing Duplex Grain Sizes," available at ASTM International, West Conshohocken, Pa. The grain size may be refined using any method known in the art, such as reduction by hot working at temperatures in the austenite phase field at a temperature generally between 850° C. and 1100° C. and preferably between 900° C. and 1000° C. In another embodiment, the creep resistant alloy is comprised of a $M_{23}C_6$ carbide volume percent from about 7% to about 13%. The $M_{23}C_6$ carbide volume percent may be determined through methods known in the art, such as carbon extraction replica and thin foil transmission electron microscopy. See e.g., Vandervoort, *ASM Handbook Volume 9: Metallography and Microstructures,* 2004, ASM International: Materials Park, Ohio, among others.

In a specific embodiment, an embodiment of the creep resistant alloy was produced by vacuum induction melting of elemental charge materials. The melt was solidified into a cast ingot. The cast ingot was subsequently homogenized at 1130° C. for 1 hour then at 1250° C. for 8 hours in order to establish a residual inhomogeneity of about 1% over a 50 μm characteristic distance, then hot worked in the austenite phase field (Temperature=985° C.–1000° C.) by forging operations followed by hot rolling, with reductions per operation of about 15% for a total reduction of about 90%. Following the reduction, the material had an ASTM grain size of about 3 with a nominal grain diameter of about 125 μm. This was followed by austenizing at 1150° C. for 30 minutes, then air cooling to room temperature, then tempering at 700° C. for 1 hour, then air cooling to room temperature. The resulting creep resistant martensitic steel was evaluated for creep life and creep potential against several commercially available 9-12 Cr steels known as COST FB2, COST E, and COST B2. The compositions of the resulting creep resistant alloy (CPJ-7) and the commercially available 9-12 Cr steels are listed at Table 1.

Creep life was determined for the resulting creep resistant martensitic steel and the commercially available 9-12 Cr steels at a temperature of 650° C. under various stresses, with results as presented at Table 2. As indicated, creep rupture life for the resulting creep resistant martensitic steel significantly exceeds the COST FB2, COST B2, and COST E steels. Note also that the resulting creep resistant martensitic steel of this particular embodiment had an ASTM grain size of around 3, as earlier indicated, while the ASTM grain sizes of COST FB2, COST B2, and COST E steels were about 1.5, >1, and about 3, respectively. As a result, the resulting creep resistant martensitic steel displayed superior creep properties with a grain size less than or approximately equivalent to the commercial steels evaluated. This is contrary to the typically expected trend, where increased grain sizes generally improve creep performances, and indicates the overall composition provides significant advantage in the formation of subgrain structures, the density of free dislocations, the number and location of pinning particles such as MX and $M_{23}C_6$, and/or other structural factors which generally act to improve creep performance. See e.g., Maruyama et al., "Strengthening Mechanisms of Creep Resistant Tempered Martensitic Steel," *ISIJ International* 41 (2001), among others.

Figure 3:
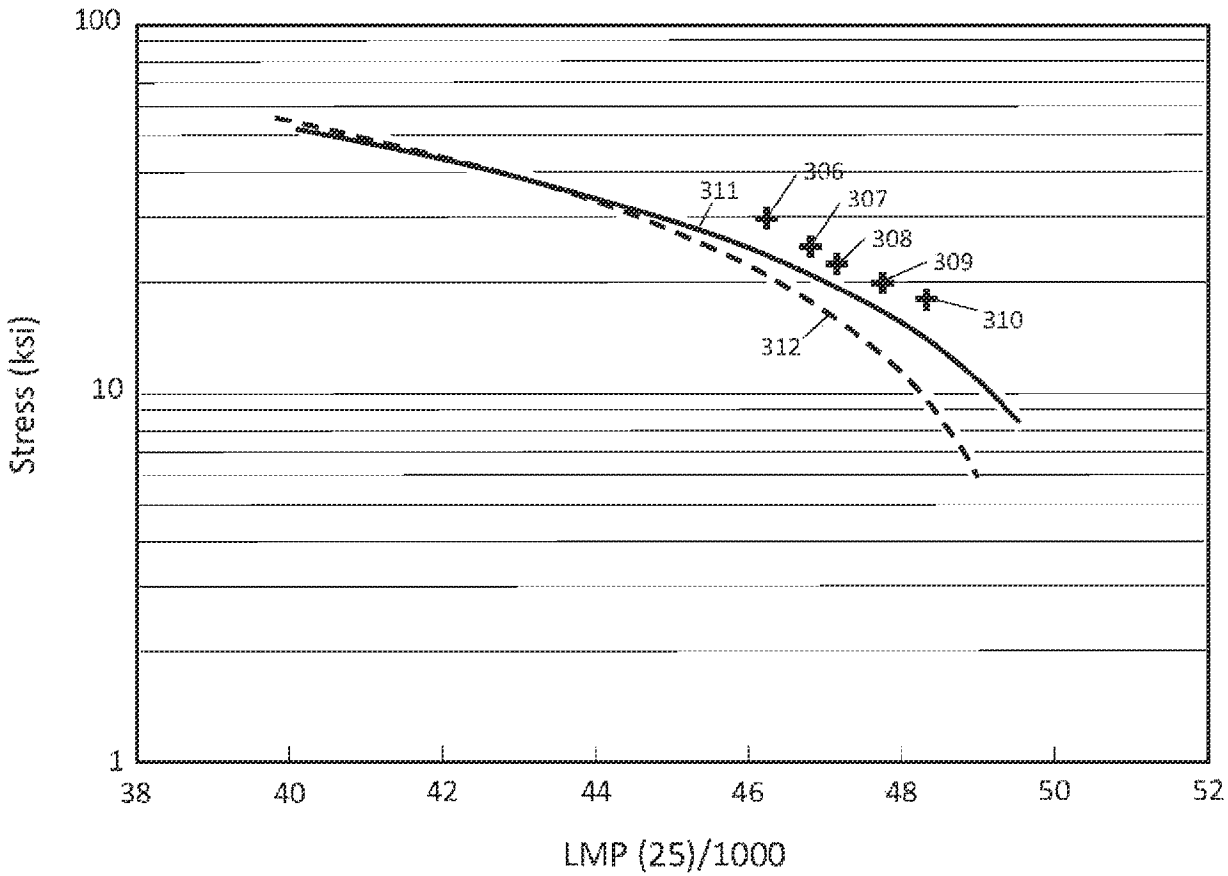
FIG. 3 illustrates the Larson-Miller parameter of the creep resistant martensitic steel compared to the commercial steels COST FB2 and COST E.

Additionally, FIG. 3 compares the Larson-Miller (L-M) parameter of the creep resistant martensitic steel with the values obtained for the COST FB2 and COST E steels. The L-M parameter for the creep resistant martensitic steel is indicated at points 306, 307, 308, 309 and 310. Curve 311 indicates the L-M parameters for the COST FB2 while curve 312 indicates the L-M parameters for the COST E. The Larson-Miller parameter is an empirical number reflecting the operating temperature and the creep strength of the alloy, defined in FIG. 3 as L-M=T*(log(t)+25.0), where T is the test temperature in degrees Rankine and t is the time in hours for rupture to occur at the test temperature. FIG. 3 indicates that the creep resistant alloy exhibits superior time-to-rupture as compared to the commercially available COST FB2 and COST E steels.

Thus, presented here is a creep resistant alloy comprised of at least iron, chromium, molybdenum, carbon, manganese, silicon, nickel, vanadium, niobium, nitrogen, tungsten, cobalt, tantalum, boron, and potentially additional elements in an overall composition. The overall composition strengthens the matrix with solute additions and precipitates, stabilizes the grain and sub-grain structure using carbides, and engenders a high density of dislocations with thermo-mechanical processing (TMP) and heat treatment. The overall composition and minimization of compositional inhomogeneities within the characteristic distance ameliorates sources of microstructural instability such as coarsening of $M_{23}C_6$ carbides and MX precipitates, and mitigates or eliminates Laves and Z-phase formation. The carbon, vanadium, niobium, tantalum, and nitrogen generate MX carbides to slow down dislocation movement, and a balanced amount of Mo and W generate solution and precipitation hardening by $M_{23}C_6$. The cobalt, manganese, nickel and carbon suppress δ-ferrite and provide additional precipitate strengthening and oxidation resistance, and the addition of boron stabilizes $M_{23}C_6$ precipitates and the sub-grain structure. The creep resistant alloy exhibits improved high-temperature creep strength in the temperature environment of around 650° C.

It is to be understood that the above-described arrangements are only illustrative of the application of the principles of the present invention and it is not intended to be exhaustive or limit the invention to the precise form disclosed. Numerous modifications and alternative arrangements may be devised by those skilled in the art in light of the above teachings without departing from the spirit and scope of the present invention. It is intended that the scope of the invention be defined by the claims appended hereto.

In addition, the previously described versions of the present invention have many advantages, including but not limited to those described above. However, the invention does not require that all advantages and aspects be incorporated into every embodiment of the present invention.

All publications and patent documents cited in this application are incorporated by reference in their entirety for all purposes to the same extent as if each individual publication or patent document were so individually denoted.

TABLE 1

Composition in wt. % CPJ-7, COST FB2, COST E, and COST B2.

| | C | Mn | Si | Ni | Cr | Mc | V | Nb | N | W | B | Co | Ta | Fe |
|---|---|---|---|---|---|---|---|---|---|---|---|---|---|---|
| CPJ-7 | 0.15 | 0.41 | 0.09 | 0.27 | 9.83 | 1.26 | 0.21 | 0.056 | 0.02 | 0.48 | 0.01 | 1.48 | 0.28 | Bal |
| COST FB2 | 0.13 | 0.3 | 0.08 | 0.05 | 9.3 | 1.5 | 0.2 | 0.05 | 0.026 | — | 0.01 | 1 | — | Bal |
| COST E | 0.12 | 0.45 | 0.1 | 0.74 | 10.4 | 1.1 | 0.18 | 0.045 | 0.05 | 1 | — | — | — | Bal |
| COST B2 | 0.18 | 0.06 | 0.1 | 0.09 | 9.28 | 1.54 | 0.29 | 0.06 | 0.02 | — | 0.01 | — | — | Bal |

TABLE 2

Creep Rupture Life CPJ-7, COST FB2, COST E, and COST B2.

| | Creep Rupture Life (hours) | | | |
|---|---|---|---|---|
| Stress (ksi) | CPJ-7 | COST FB2 | COST E | COST B2 |
| 30 | 666 | — | — | — |
| 25 | 1618 (*) | 614 | 223 | 655 |
| 22.5 | 2344 | 1127 | — | — |
| 20 | 5388 | 1783 | 843 | 2425 |
| 18 | 12727 | 3483 | 3198 | 4148 |
| 15 | >14400 | — | — | 13759 |

NOTE:
(*) denotes an average of four creep tests.

What is claimed is:

1. A creep resistant alloy having an overall composition comprised of iron and further comprised of from 9.75 to 10.25 wt. % Cr, from 1.0 to 1.5 wt. % Mo, from 0.13 to 0.17 wt. % C, from 0.25 to 0.50 wt. % Mn, from 0.08 to 0.15 wt. % Si, from 0.15 to 0.30 wt. % Ni, from 0.15 to 0.25 wt. % V, from 0.05 to 0.08 wt. % Nb, from 0.015 to 0.035 wt. % N, from 0.25 to 0.75 wt. % W, from 1.35 to 1.65 wt. % Co, from 0.20 to 0.30 wt. % Ta, and from 70 ppm to 110 ppm B, and where the creep resistant alloy has a $M_{23}C_6$ carbide volume percent from 7% to 13%.

2. The creep resistant alloy of claim 1 where a molybdenum equivalent Mo(eq) is equal to the wt. % Mo added to one-half the wt. % W in the overall composition, and where a quantity (C+N) is equal to the wt. % C added to the wt. % N in the overall composition, and where the molybdenum equivalent Mo(eq) is from 1.475 to 1.700 wt. % and the quantity (C+N) is from 0.145 to 0.205.

3. The creep resistant alloy of claim 2 where the overall composition of the creep resistant alloy is comprised of less than 0.004 wt. % Ti.

4. The creep resistant alloy of claim 2 where the overall composition of the creep resistant alloy is comprised of less than 100 ppm S.

5. The creep resistant alloy of claim 2 where the creep resistant alloy has an ASTM grain number of greater than or equal to 2.5.

6. The creep resistant alloy of claim 1 where the creep resistant alloy is a creep resistant martensitic steel comprised of alpha-iron having a body-centered tetragonal crystal structure.

7. A creep resistant martensitic steel comprised of alpha-iron having a body-centered tetragonal crystal structure and having an overall composition comprised of iron and further comprised of from 9.75 to 10.25 wt. % Cr, from 1.0 to 1.5 wt. % Mo, from 0.13 to 0.17 wt. % C, from 0.25 to 0.50 wt. % Mn, from 0.08 to 0.15 wt. % Si, from 0.15 to 0.30 wt. % Ni, from 0.15 to 0.25 wt. % V, from 0.05 to 0.08 wt. % Nb, from 0.015 to 0.035 wt. % N, from 0.25 to 0.75 wt. % W, from 1.35 to 1.65 wt. % Co, from 0.20 to 0.30 wt. % Ta, and from 70 ppm to 110 ppm B, and where the overall composition is comprised of a molybdenum equivalent Mo(eq) from 1.475 to 1.700 wt. % and a quantity (C+N) from 0.145 to 0.205, where the molybdenum equivalent Mo(eq) is equal to the wt. % Mo added to one-half the wt. % W in the overall composition and where the quantity (C+N) is equal to the wt. % C added to the wt. % N in the overall composition, and where the creep resistant martensitic steel has an ASTM grain number of greater than or equal to 2.5 and a $M_{23}C_6$ carbide volume percent from 7% to 13%.

8. The creep resistant martensitic steel of claim 7 where a residual inhomogeneity of the creep resistant martensitic steel is less than 10%.

9. The creep resistant martensitic steel of claim 8 where the overall composition of the creep resistant martensitic steel is comprised of less than 0.004 wt. % Ti.

10. The creep resistant martensitic steel of claim 8 where the overall composition of the creep resistant martensitic steel is comprised of less than 100 ppm S.

11. The creep resistant alloy of claim 1 where the creep resistant alloy is a creep resistant martensitic steel, and where a residual inhomogeneity of the creep resistant martensitic steel is less than 10%.

12. The creep resistant alloy of claim 1 where the overall composition comprises from 0.015 to less than 0.025 wt. % N.

13. A creep resistant alloy having an overall composition comprised of iron and further comprised of from 9.75 to 10.25 wt. % Cr, from 1.0 to 1.5 wt. % Mo, from 0.13 to 0.17 wt. % C, from 0.25 to 0.50 wt. % Mn, from 0.08 to 0.15 wt. % Si, from 0.15 to 0.30 wt. % Ni, from 0.15 to 0.25 wt. % V, from 0.05 to 0.08 wt. % Nb, from 0.015 to less than 0.025 wt. % N, from 0.25 to 0.75 wt. % W, from 1.35 to 1.65 wt. % Co, from 0.20 to 0.30 wt. % Ta, and from 70 ppm to 110 ppm B.

14. The creep resistant alloy of claim 13 where a molybdenum equivalent Mo(eq) is equal to the wt. % Mo added to one-half the wt. % W in the overall composition, and where a quantity (C+N) is equal to the wt. % C added to the wt. % N in the overall composition, and where the molybdenum equivalent Mo(eq) is from 1.475 to 1.700 wt. % and the quantity (C+N) is from 0.145 to 0.205.

15. The creep resistant alloy of claim 14 where the creep resistant alloy is a creep resistant martensitic steel comprised of alpha-iron having a body-centered tetragonal crystal structure.

16. The creep resistant alloy of claim 15 where the creep resistant alloy has a $M_{23}C_6$ carbide volume percent from 7% to 13%.

17. The creep resistant martensitic steel of claim 16 where the creep resistant alloy is a creep resistant martensitic steel, and where a residual inhomogeneity of the creep resistant martensitic steel is less than 10%.

* * * * *